United States Patent [19]

Schaming

[11] 4,407,845

[45] Oct. 4, 1983

[54] IONIC STRIP COATING METHOD

[76] Inventor: Edward J. Schaming, P.O. Box 1070, Butler, Pa. 16001

[21] Appl. No.: 389,270

[22] Filed: Jun. 17, 1982

Related U.S. Application Data

[62] Division of Ser. No. 283,643, Jul. 15, 1981, Pat. No. 4,391,219.

[51] Int. Cl.[3] ..... B05D 1/04; B05D 5/08

[52] U.S. Cl. ..... 427/13; 427/209; 427/424

[58] Field of Search ..... 118/315, 629–633, 118/325; 427/13, 32, 33, 424, 420, 30, 209; 239/295, 296, 420, 705, 193, 194

[56] References Cited

U.S. PATENT DOCUMENTS

| | | | |
|---|---|---|---|
| 2,130,241 | 9/1938 | MacLaurin | 118/325 X |
| 2,666,716 | 1/1954 | Kadell | 118/630 X |
| 3,608,822 | 9/1971 | Berthoud | 118/629 X |
| 3,736,902 | 6/1973 | Glanzer | 118/325 X |

FOREIGN PATENT DOCUMENTS

| | | | |
|---|---|---|---|
| 1430231 | 3/1976 | United Kingdom | 118/315 |

*Primary Examiner*—Evan K. Lawrence
*Attorney, Agent, or Firm*—D. Paul Weaver

[57] ABSTRACT

A high voltage charge at very low amperage is impressed on a bath of oil or other lubricant in a dielectric header through a submerged electrode. A grounded high speed moving metal strip attracts streams of the charged bath across its width through apertures or slots provided in the header. Pressurized gas jets directed at these streams disperse the streams into a multitude of finer crossing streams which coat the strip completely and evenly. A recovery system for the oil or other lubricant is provided.

7 Claims, 6 Drawing Figures

FIG. 1
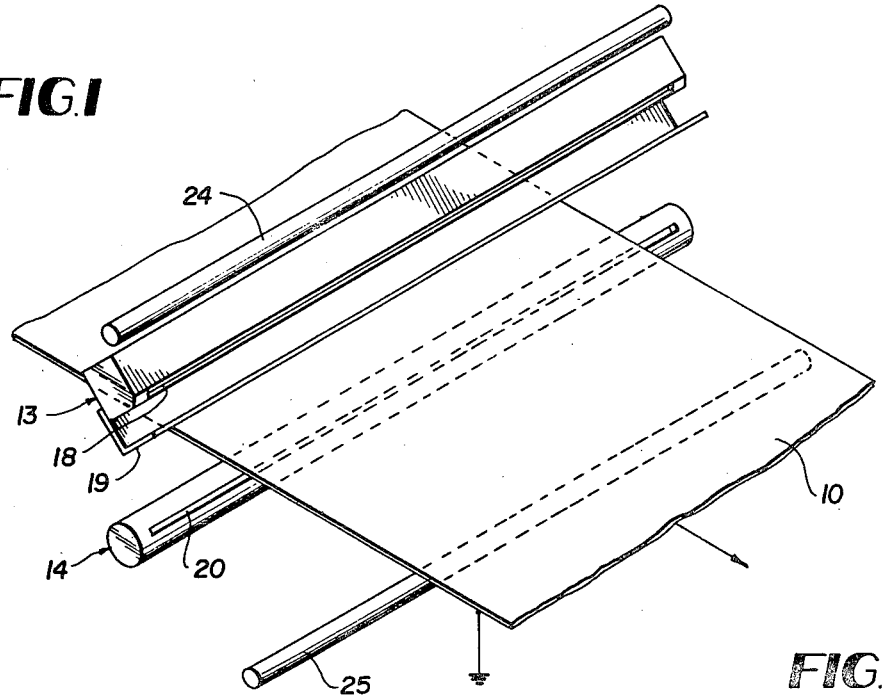
FIG. 2
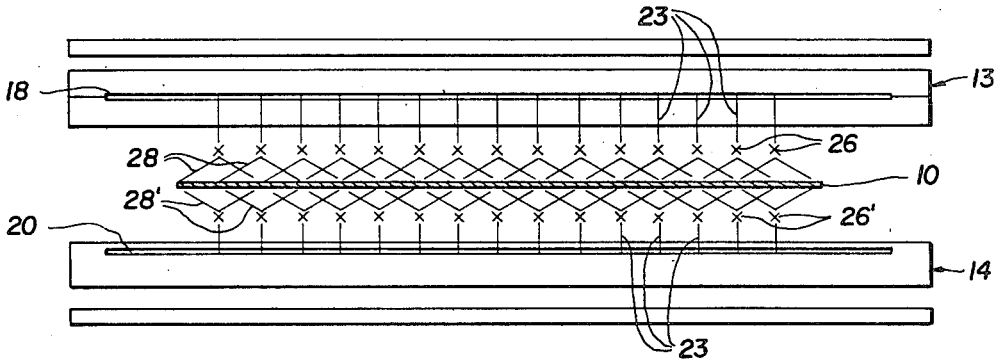
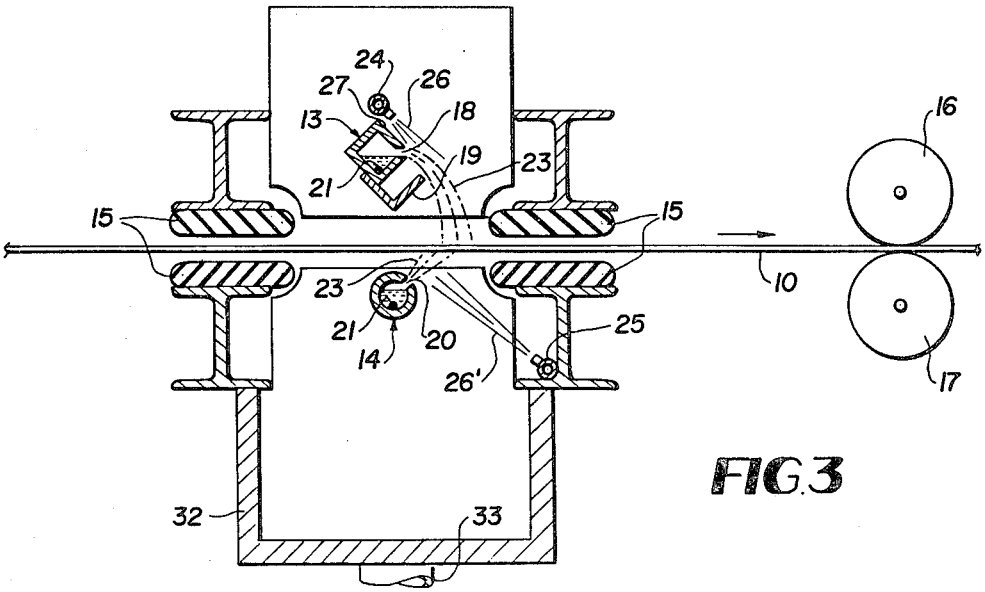
FIG. 3

FIG.5
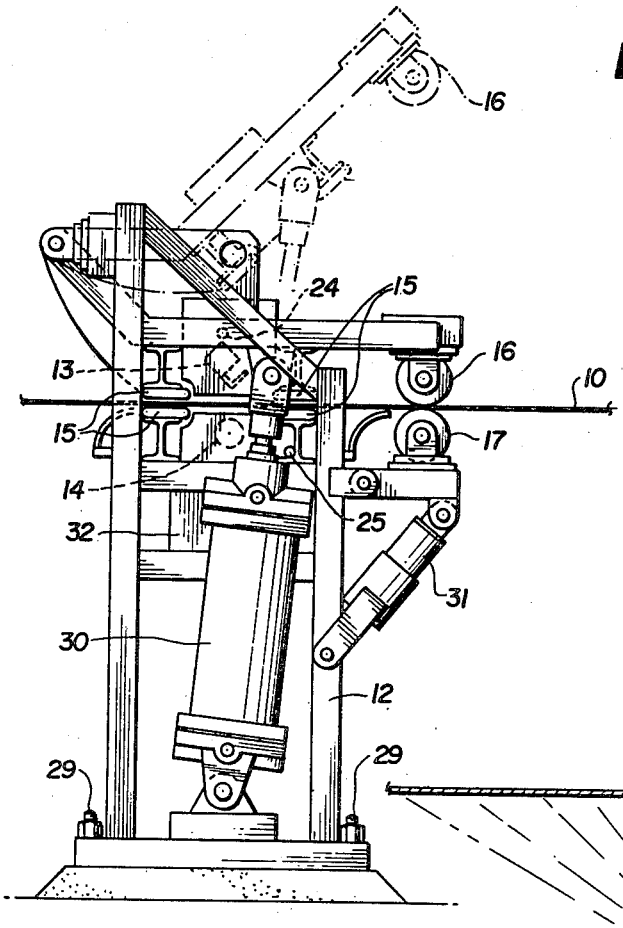
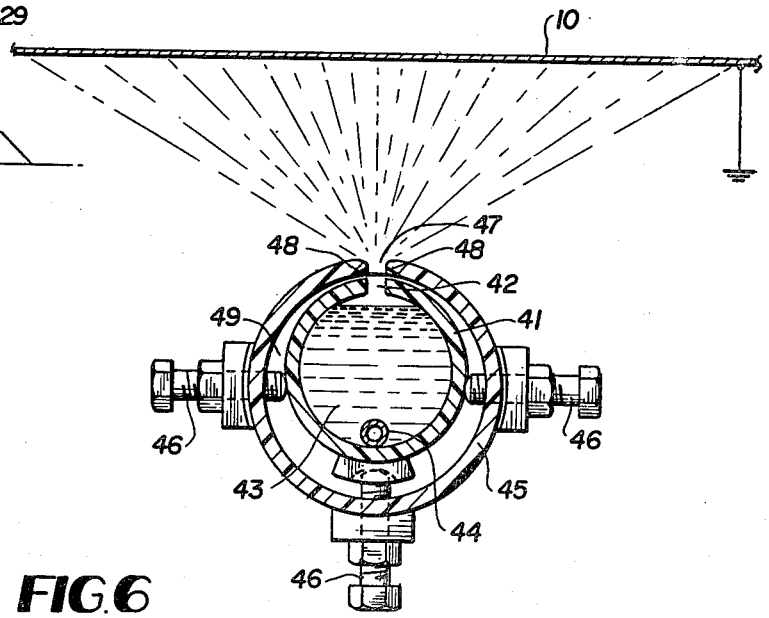
FIG.6

IONIC STRIP COATING METHOD

This application is a division of application Ser. No. 283,643, filed July 15, 1981, now U.S. Pat. No. 4,391,219.

BACKGROUND AND SUMMARY OF THE INVENTION

The invention seeks to provide a more efficient and economical method for coating a metal strip moving at high speed in a rolling mill or process line with oil or other lubricant. More particularly, the invention provides an improved ionic strip coating method which operates at a much lower and safer voltage and amperage than known prior art systems, lessens the consumption of oil and more completely and uniformly coats the metal strip on both sides during its passage through a very compact coating apparatus which requires much less floor space than prior art systems. The apparatus used to carry out the method is a unit which contains an electrical power supply, a circulating system for lubricant enabling excess lubricant to be recovered, and a pair of pinch rolls through which the lubricated strip may pass. The propose of the pinch rolls is only to hold a fixed pass line of the strip with respect to the oil discharge headers.

In accordance with an important feature which distinguishes the invention from the prior art, a pressurized gas, such as air, in the form of jets or sprays is directed at the attracted oil streams as they exit from a header and these streams are dispersed into a multitude of finer streams in a crossing pattern which assures complete and uniform coating of the moving strip across its full width.

Known prior art ionic systems operate at a voltage and current value far above that of the invention, and consequently are capable of causing a lethal shock. Prior art voltage and current are of the order of 150,000 volts at 1000 microamps. In contrast of this, the invention utilizes 60,000 to 100,000 V. at only about 10 microamps. As a consequence, the invention is entirely safe and cannot cause a lethal shock.

Additionally, from a construction standpoint, the apparatus employed in the method is much simpler and more compact than the prior art.

Other features and advantages of the invention will become apparent during the course of the following description.

BRIEF DESCRIPTION OF THE DRAWINGS

FIG. 1 is a partly schematic perspective view of the apparatus used in the method of the invention.

FIG. 2 is a schematic cross section through the moving strip depicting the dispersing of lubricant streams caused by the pressurized air jets or sprays.

FIG. 3 is a cross sectional view taken through the coating apparatus.

FIG. 5 is a side elevational view of the apparatus.

FIG. 6 is a cross sectional view showing a modification of the apparatus.

DETAILED DESCRIPTION

Figure 4:
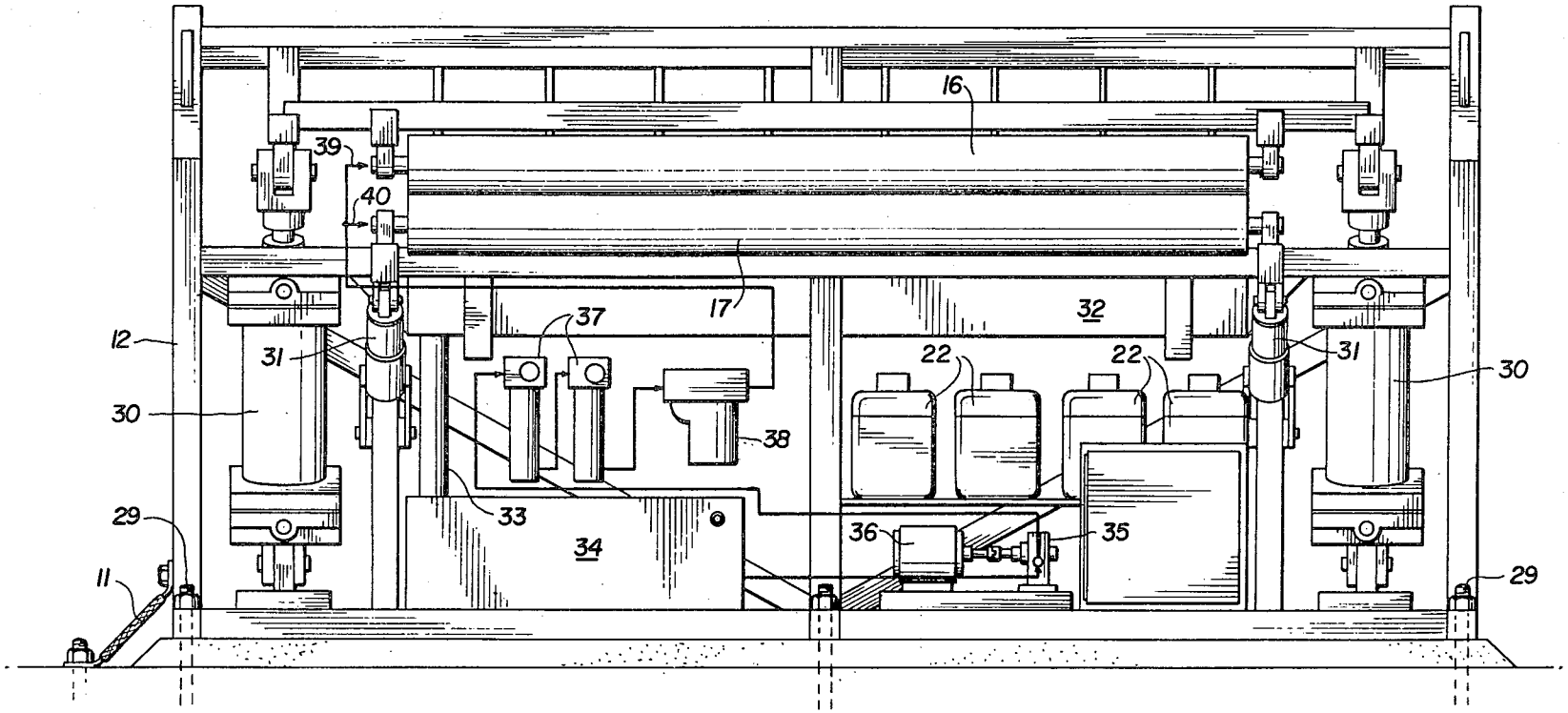
FIG. 4 is a front elevational view of the apparatus.

Referring to the drawings in detail wherein like numerals designate like parts, the numeral 10 designates a metal strip moving at a speed of as much as 6000 feet per minute through a coating apparatus constructed as shown in the drawings. The strip 10 is electrically grounded through a ground strap 11 connected to the frame 12 of the coating apparatus.

The heart of the ionic coating apparatus used in the method of the invention is depicted in FIGS. 1, 2 and 3 of the drawings and comprises upper and lower coating headers 13 and 14 formed of dielectric material and extending transversely across the width of the moving strip 10 above and below the same in spaced relationship thereto. The strip 10 passes between pairs of upstream and downstream dielectric guard bars 15 in closely spaced relationship to the strip and somewhat further downstream through top and bottom pinch rolls 16 and 17.

The upper header 13 is preferably square in cross section with its four corners located on vertical and horizontal orthogonal axes. An outlet slot 18 for oil or other liquid lubricant is provided at the downstream corner of the header and extends substantially for its entire length. A gutter member 19 of L-shaped cross section is preferably secured to the upper header 13 as shown in FIG. 3 with the lip of the gutter member spaced slightly below and downstream from the outlet slot 18.

The lower lubricant header 14 may be circular in cross section, or a different shape in some cases. It has an outlet slot 20 in its upper downstream quadrant extending for substantially its entire length and located substantially below the slot 18.

Each of the headers 13 and 14 is adapted to contain a pool of lubricant therein up to the approximate level of the slot 18 or 20. An electrode rod 21 at the bottom of each header 13 and 14 and completely submerged in the header lubricant bath receives a charge from an appropriate power supply 22 contained in the apparatus. Typically, this charge impressed on the electrodes 21 has a magnitude of 60,000–100,000 V. at 10 microamps, which is a very safe charge and will not cause a lethal shock to workers. This ionic charge on the lubricant baths in the two headers causes the liquid lubricant to be attracted to the grounded moving strip 10 in accordance with a known phenomenon. This attraction results in plural discrete streams 23 of lubricant being drawn from the two slots 18 and 20 and propelled toward the top and bottom of the strip 10 at converging angles, FIG. 3.

A very important aspect of the apparatus is the provision of two compressed air manifolds 24 and 25 at the top of header 13 and below and downstream from the header 14, respectively, FIG. 3. These two manifolds 24 and 25 are apertured or slotted along their lengths in parallel relationship to the slots 18 and 20. In the use of the system, the air manifold 24 delivers pressurized air sprays 26 downwardly in close relationship to the upper downstream inclined wall 27 of header 13 so as to impinge on the liquid lubricant streams 23 as they exit the slot 18 due to attraction to the grounded strip 10. This impingement of the air sprays on the liquid streams 23 disturbs and disperses the liquid streams into a multitude of very fine intersecting and crossing streams 28 across the top of the strip 10, FIG. 2, to completely and uniformly coat the top of the strip by utilization of a minimum amount of oil, or other lubricant. The combination of the attracted liquid streams 23 and the action of the air jets or sprays 26 thereon to disperse the streams eliminates entirely uncoated areas on the strips 10, excessive coating, and pooling of lubricant, thereby preventing waste of oil, overcoating or undercoating.

In the coating of the top side of strip 10, the multiple air sprays 26 are normally required. In some cases, the coating of the bottom of the strip may not require the air sprays 26' from the lower air manifold 25. When used, the air sprays 26' are directed tangentially across the outlet slot 20 to impinge on the upwardly directed streams 23 generally normal to their axes. This results in dispersing the liquid streams into a multiplicity of much finer intersecting and crossing streams 28' which completely and uniformly coat the bottom of the strip 10 in substantially the same manner that its top side is being simultaneously coated.

A favorable aspect of the process is that it is self-adjusting to the width of the strip 10. That is, if the strip 10 is narrower than the lengths of the headers 13 and 14 and their outlet slots 18 and 20, the oil will only be pulled out of the slots across the width of the strip and not beyond the two longitudinal wedges of the strip. A wider strip 10 up to the full lengths of the slots 18 and 20 will attract the liquid lubricant across its entire width.

Compressed air for the headers 24 and 25 is supplied from any convenient remote source, not shown. The air pressure intensity required is less than 10 PSIG, thereby avoiding any contamination of a local area with lubricant fumes.

The apparatus in FIGS. 4 and 5 is a unit which occupies comparatively little floor space and is anchored to the floor at 29. The coating components and the pinch rolls 16 and 17 span the grounded strip 10 transversely at right angles to its path of movement. Power cylinders 30 are provided on the apparatus to raise and lower the top pinch roll 16 relative to the lower roll 17 which is spring-loaded by devices 31. The apparatus further contains a drain basin 32 for the excess coating lubricant which returns the collected lubricant through a pipe 33 to a reservoir 34. From this reservoir, a pump 35 operated by a motor 36 circulates the oil through heaters 37 which maintain it at a temperature of approximately 180° F. This temperature may vary depending on viscosity of the coating fluid. From these heaters, the oil passes through a filter 38 and from the filter passes through lines 39 and 40 leading into the two headers 13 and 14 where the oil is pooled.

FIG. 6 depicts a modification of the apparatus wherein the grounded strip 10 is shown above a circular liquid lubricant header 41 having an upper outlet slot 42 and containing a pool 43 of oil or the like within which a charged electrode 44 is submerged. Surrounding the header 41 eccentrically in downwardly offset relationship is an air manifold 45 and set screw means 46 to adjust the air manifold relative to the liquid header. The manifold 45 has an upper outlet slot 47 for an air spray including convergent walls 48. Air under pressure is supplied to the chamber 49 between the header 41 and manifold 45, the chamber diminishing in radial width toward its top.

In operation, the liquid lubricant which is ionically charged is attracted through the slot 42 toward the moving strip 10. Simultaneously, an air spray is emitted through the slot 47 and disperses the liquid in a fine spray which spans approximately 120° included angle to coat the bottom of the strip 10 completely and uniformly. Without the introduction of the air spray, the coating is not complete and uniform because the liquid emitting from the header 41 is in the form of spaced streams which impinge on the strip in an uneven and unequal manner. The inclusion of the air not only disperses these streams but creates a nearly homogeneous depositing of the liquid lubricant on the metal strip.

While FIG. 6 depicts a coating arrangement for the bottom of the strip 10, it should be understood that a like coating unit can be mounted above the strip for the simultaneous coating of its top. The other described advantages of the prior embodiment of the invention are also obtained with the embodiment shown in FIG. 6.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A method of coating a moving strip with lubricant or the like comprising directing streams of liquid lubricant from a body of liquid lubricant onto at least one side of a moving strip, simultaneously directing pressurized air sprays onto said streams to disperse the streams into a multitude of much finer streams substantially in a crossing pattern to thereby coat the moving strip completely and uniform, and propelling said streams toward said strip by attraction created by impressing a high voltage low current charge on said body of liquid lubricant and electrically grounding the moving strip.

2. The method of claim 1, and directing the liquid streams in convergent relationship and on a downstream path relative to the movement of said strip.

3. The method of claim 1, and the additional step of recovering and recycling the liquid lubricant in a continuous circulating system.

4. The method of claim 1, and directing said streams simultaneously onto the top and bottom sides of a horizontally moving strip while guiding the strip, and directing the air sprays onto said streams at the top and bottom of the strip to disperse them into said multitude of said finer streams.

5. A method of coating a high speed moving metal strip with lubricant comprising the steps of impressing a high voltage low current electrical charge on bodies of liquid lubricant contained near opposite sides of the moving strip in spaced relationship thereto, electrically grounding the moving metal strip whereby discrete small streams of liquid lubricant from said bodies of liquid lubricant will be attracted toward the moving strip continuously, and simultaneously directing pressurized gas sprays onto said discrete streams of lubricant thereby dispersing said streams into a multitude of finer fan-like lubricant sprays in a crossing pattern and allowing the dispersed crossing lubricant sprays to impinge on the opposite faces of the moving metal strip to thereby coat the strip completely and uniformly.

6. The method of claim 5, wherein the pressurized fluid sprays are pressurized air sprays.

7. The method of claim 6, and wherein the pressurized air sprays are aimed at acute angles to the movement path of the metal strip.

* * * * *